US007537113B2

(12) United States Patent
Tambo

(10) Patent No.: US 7,537,113 B2
(45) Date of Patent: May 26, 2009

(54) HINGE-LID TYPE PACKAGE FOR ROD-LIKE SMOKING ARTICLES AND A BLANK THEREFOR

(75) Inventor: Hitoshi Tambo, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 11/477,932

(22) Filed: Jun. 30, 2006

(65) Prior Publication Data

US 2006/0249408 A1 Nov. 9, 2006

Related U.S. Application Data

(63) Continuation of application No. PCT/JP2005/002475, filed on Feb. 17, 2005.

(30) Foreign Application Priority Data

Mar. 12, 2004 (JP) ..... 2004-071193

(51) Int. Cl.
*A24F 15/00* (2006.01)
*B65D 85/10* (2006.01)
*B65D 85/12* (2006.01)

(52) U.S. Cl. ..... 206/264; 206/247; 206/268; 206/273; 229/160.1

(58) Field of Classification Search ..... 206/259, 206/265, 266, 268, 271, 242, 247, 273, 264, 206/459.5, 254, 831; 229/160.1, 87.12, 87.13, 229/87.14
See application file for complete search history.

(56) References Cited

U.S. PATENT DOCUMENTS 2,361,659 A 10/1944 Smith et al.
2,983,424 A * 5/1961 Glass ..... 229/121
3,093,292 A * 6/1963 Ahlbor ..... 206/264
3,245,525 A * 4/1966 Shoemaker ..... 206/264
3,999,655 A * 12/1976 Molins et al. ..... 206/259
4,113,104 A 9/1978 Meyers
4,300,676 A * 11/1981 Focke et al. ..... 206/264
4,732,276 A 3/1988 Knecht
5,363,955 A * 11/1994 Fleenor ..... 206/273
5,366,077 A * 11/1994 Pham ..... 206/268
5,553,773 A * 9/1996 Focke et al. ..... 229/224
5,575,386 A * 11/1996 Focke et al. ..... 206/264
5,678,690 A 10/1997 Belvederi et al.
6,302,322 B1 * 10/2001 Focke et al. ..... 229/160.1

FOREIGN PATENT DOCUMENTS

CN 86 1 02898 A 11/1986

(Continued)

*Primary Examiner*—Bryon P Gehman
*Assistant Examiner*—Ernesto A Grano
(74) *Attorney, Agent, or Firm*—Birch, Stewart, Kolasch & Birch, LLP

(57) ABSTRACT

A hinge-lid type package for containing an inner pack (IP) of filter cigarettes has an outer body (10), a lid (12) for opening and closing an upper opening end (26) of the outer body (10), and a pair of connector tabs (36) connected to the upper opening end (26) through a breaking line (38). When the package is produced, the connector tabs (36) enter the lid (12) to be adhered to the inner surface of the lid (12). When the connector tabs (36) are broken along the breaking line (38), the connector tabs (36) leave breaking traces (X) in both the outer body (10) and the lid (12).

8 Claims, 10 Drawing Sheets

FOREIGN PATENT DOCUMENTS

| | | | |
|---|---|---|---|
| EP | 0 675 056 | A | 10/1995 |
| JP | 51-128820 | U | 10/1976 |
| JP | 61-134924 | U | 8/1986 |
| JP | 1-122419 | U | 8/1989 |
| JP | 8-58777 | A | 3/1996 |
| JP | 8-169485 | A | 7/1996 |
| RU | 2 202 504 | C2 | 4/2003 |

* cited by examiner

HINGE-LID TYPE PACKAGE FOR ROD-LIKE SMOKING ARTICLES AND A BLANK THEREFOR

This application is a Continuation of copending PCT International Application No. PCT/JP2005/002475 filed on Feb. 17, 2005, which designated the United States, and on which priority is claimed under 35 U.S.C. § 120. This application also claims priority under 35 U.S.C. § 119(a) on Patent Application No(s). 2004-071193 filed in Japan on Mar. 12, 2004. The entire contents of each of the above documents is hereby incorporated by reference.

TECHNICAL FIELD

The present invention relates to a hinge-lid type package for rod-like smoking articles, such as cigarettes and filter cigarettes, and a blank therefor.

BACKGROUND ART

For instance, a hinge-lid type package of this type is disclosed in Unexamined Japanese Patent Publication No. 8-58777. This well-known package includes a box-shaped outer body having an opening end at the upper end thereof. The outer body contains an inner pack in its inside, and the inner pack has a cigarette bundle of cigarettes, filter cigarettes or the like, and an inner wrapper for wrapping the cigarette bundle.

The opening end of the outer body is provided with a box-shaped lid at the rear edge of the opening end with a hinge therebetween. The lid is rotated around the hinge and allows the opening end to open and close. More specifically, the package includes an inner frame between the outer body and the inner pack. The inner frame has a U-shaped cross section that surrounds the inner pack and reinforces the opening end of the outer body. The inner frame has an upper end portion protruding from the opening end of the outer body, and the upper end portion guides the opening and closing of the lid.

The package is further wrapped in a transparent film with a tear tape. Such film wrapper is useful for preventing tampering on the inner pack.

As mentioned above, since the cigarette bundle is triply wrapped in the inner wrapper, the outer body and the film wrapper, the cigarette bundle is excessively wrapped. Therefore, the manufacture of packages of this kind not only consumes a large quantity of wrapping resources for cigarette bundles but also requires three wrapping steps to pack the bundle. Consequently, the packaging equipment for packages costs a great deal.

The tear tape of a film wrapper has a free end, or a pull end. Such a pull end helps opening the film wrapper, but on the other hand is deformed as it is in a free state, thereby easily curling up from the package.

For this reason, in a case that vending machines are used for dispensing the packages, the pull end of the tear tape is liable to get caught on a dispensing guide or the like for the packages in a vending machine. Such a catch could cause a trouble in the dispensing of the package from the vending machine. When the environment around the package is high in both temperature and humidity, the pull end of the tear tape is prone to curl up from the package, which frequently incurs the above-mentioned trouble.

DISCLOSURE OF THE INVENTION

It is an object of the present invention to provide a hinge-lid type package for rod-like smoking articles and a blank therefor, the package being provided with effective countermeasures against tampering without film wrapping and being therefore suitable for saving wrapping resources.

To accomplish the above object, the hinge-lid type package for rod-like smoking articles of the present invention comprises an inner pack having an inner wrapper in which a bundle of rod-like smoking articles is wrapped and a rectangular parallelepiped casing for accommodating the inner pack. The casing includes an outer body with an opening end, a lid connected to the opening end of the outer body with a rear edge of the opening end used as a hinge, for opening and closing the opening end of the outer body, the lid having an opening end for meeting the opening end of the outer body so that the opening ends are confronted with each other when in a closed position, and a breakable connecting element for connecting the opening end of the outer body and the opening end of the lid when the casing is formed.

With the above-described package, after the casing is formed, when the lid is applied with an opening force for the first time, the connecting element is broken, and the lid is detached from the outer body. As a result, the lid becomes rotatable around the self-hinge to be capable of opening and closing the opening end of the outer body.

After the lid is opened, the breaking of the connecting element leaves breaking traces in both the opening end of the outer body and the opening end of the lid. Such breaking traces are clearly visible from the outside of the package even if the lid is closed again. The breaking traces therefore indicate that the lid has already been opened, so that the connecting element effectively serves as a countermeasure against tampering on the rod-like smoking articles in the package.

As a consequence, the package of this invention does not require film wrapping with a tear tape for wrapping the casing, thus avoiding over wrapping of the rod-like smoking articles.

Not only film but also equipment for the film wrapping is not required to produce the packages of the invention, which makes it possible to provide inexpensive packages according to this invention.

Furthermore, in a case that vending machines are used for vending the packages of the present invention, the packages of the invention incur no such trouble as mentioned above, which is attributable to the film wrapping.

Preferably, the package of the present invention may further include a separating line that detachably connects side edges of the opening end of the outer body and side edges of the opening end of the lid. In this case, specifically, side walls of the outer body and side walls of the lid each have an inner wall layer and an outer wall layer. The separating line detachably connects the inner wall layer of the outer body and that of the lid.

When the lid is applied with the opening force for the first time, the side walls of the outer body and those of the lid are detached from each other along the separating line simultaneously with the breaking of the connecting element, thereby allowing the lid to open and close. If the side walls of the outer body and those of the lid are connected to each other through the separating line, the connecting element is not accidentally broken even if the lid is applied with an external force other than the opening operation.

The connecting element may include a connector tab connected to a front edge of either one of the opening end of the outer body and that of the lid through a breaking line. The connector tab extends over the front edge of the other opening end, and is adhered to an inner surface of the outer body or of the lid that has the other opening end.

It is desired that the connecting element include a pair of connector tabs positioned in respective end portions of the front edge of the opening end.

When the lid is first applied with the opening force, the connector tab is easily broken along the breaking line.

The connecting element may have a connecting flap connected to the front edge of the opening end of the outer body through a breaking line in place of or in addition to the connector tabs. The connecting flap extends over the front edge of the opening end of the lid into the lid, to thereby form an inner wall layer of the front wall of the lid. In this case, the connecting flap also serves as a part of the lid, so that there is no need to provide the casing with a new portion for the connecting element.

A blank for forming the casing includes a body front panel having a first outer edge portion for forming the opening end of the outer body, a lid front panel having a second outer edge portion for forming the opening end of the lid, and a connecting element connected to either one of the first and second outer edge portions through the breaking line. When the casing is formed from the blank, the connecting element outwardly protrudes from one of the outer edge portions so as to be laid on the front panel having the other of the first and second outer edge portions.

Since the connecting element is a part of the blank, while the casing is formed by folding the blank, the opening ends of the outer body and the lid are detachably connected to each other with the connecting element located therebetween.

The blank further has inner side flaps forming the inner wall layers of the side walls for both the outer body and the lid. The inner side flaps each have a separating line that separably partitions the inner wall layer into an outer body-side portion and a lid-side portion.

More specifically, the connecting element is a pair of connector tabs or a connecting flap connected to the first outer edge portion of the body front panel through the breaking line. The connector tabs are positioned at respective ends of the first outer edge portion, whereas the connecting flap forms the inner wall layer of the front wall of the lid when the casing is formed from the blank.

Other characteristics of the present invention will be clarified from preferred embodiment explained with reference to the attached drawings.

BEST MODE OF CARRYING OUT THE INVENTION

Figure 1:
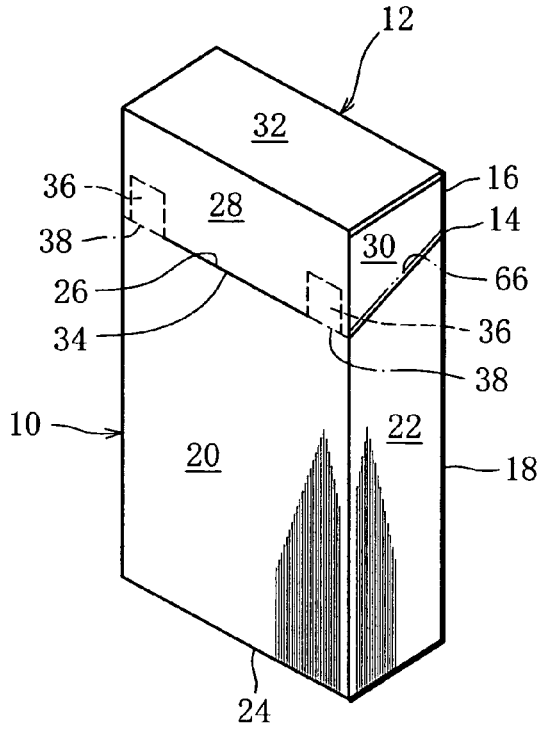
FIG. 1 is a perspective view showing a hinge-lid type package of a first embodiment.

Referring to FIG. 1, a hinge-lid type package of a first embodiment is formed as a rectangular parallelepiped, namely a box, and includes an outer body 10 and a lid 12. The lid 12 is connected to the outer body 10 with a self-hinge 14 located therebetween. The self-hinge 14 is positioned in an upper portion of a rear wall of the package and partitions the rear wall of the package into rear walls 16, 18 of the outer body 10 and the lid 12. The outer body 10 has a front wall 20, two side walls 22, a bottom wall 24 and an upper opening end 26, and the lid 12 also has a front wall 28, two side walls 30, a top wall 32 and a lower opening end 34.

As is obvious from FIG. 1, when the lid 12 is in a closed position, the opening ends 26, 34 of the outer body 10 and the lid 12 are met each other. More specifically, the opening end 26 is formed of a front edge, two inclined side edges and the self-hinge 14. The front edge is located lower than the self-hinge 14, and the inclined side edges extend from the self-hinge 14 toward the front edge at a downward slant. The opening end 34 is also formed of a front edge, two inclined side edges and the self-hinge 14.

At the time that the package is formed, the outer body 10 and the lid 12 are connected to each other through a pair of connector tabs 36. The connector tabs 36 extend from the front edge of the opening end 26 into the lid 12 to be adhered onto an inner surface of the lid 12.

A boundary between each of the connector tabs and the opening end 26 are provided as a breaking line 38. The breaking line 38 is formed of a line of perforations. Therefore, once the connector tabs 36 are separated along the breaking lines 38, the lid 12 becomes rotatable around the self-hinge 14. This allows the opening end 26 of the outer body 10 to open and close.

In a case that an ordinary hinge-lid type package and the package shown in FIG. 1 are compared to each other in terms of appearance, the package shown in FIG. 1 differs from the ordinary one in the following points i) and ii).

i) The package shown in FIG. 1 includes no film wrapping.

ii) The package shown in FIG. 1 has the connector tabs 36.

The package of FIG. 1 contains an inner pack as the ordinary package does. The inner pack is shown in FIG. 2.

Figure 2:
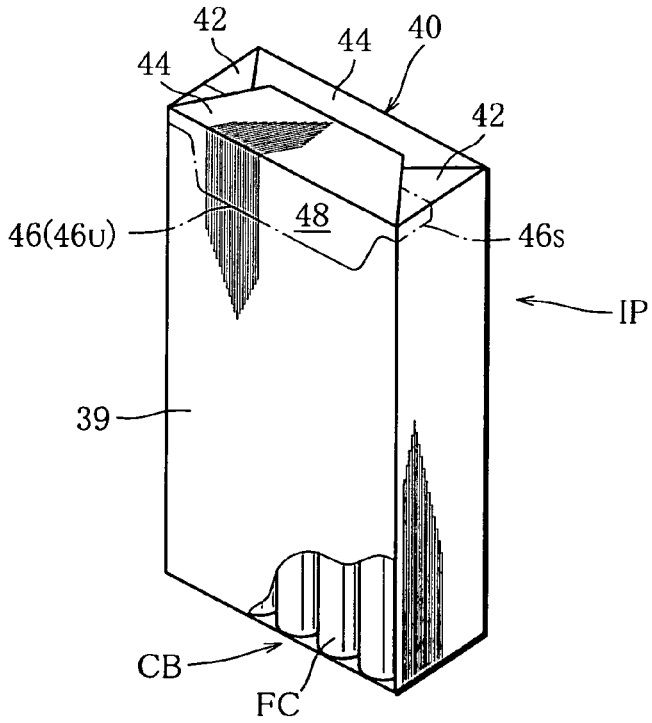
FIG. 2 is a perspective view showing an inner pack contained in the package of FIG. 1.

An inner pack IP of FIG. 2 is formed as a rectangular parallelepiped similar to the package and includes a filter cigarette bundle CB and an inner wrapper 39 for wrapping the cigarette bundle CB. Generally, the cigarette bundle CB has twenty filter cigarettes FC.

The inner wrapper 39 includes paper and an aluminum layer deposited onto a surface of the paper. The aluminum layer of the inner wrapper 39 not only protects the cigarette bundle CB from moisture but also prevents emission of aroma from the cigarette bundle CB, or from each of the filter cigarettes FC. As the inner wrapper 39, laminated paper may be utilized in place of the aluminum-deposited paper. The laminated paper has a shield layer for preventing the moisture and aroma from permeating through the inside thereof.

The inner wrapper 39 has closing faces for closing upper and lower faces of the cigarette bundle, the closing faces being formed by folding a part of the inner wrapper 39. FIG. 2 shows an upper closing face 40 only. The closing face 40 includes folding sides 42 located on respective sides thereof and closing flaps 44 sequentially superimposed upon the folding sides 42. The closing flaps 44 are produced simultaneously with the forming of the folding sides 42 and each have a trapezoidal shape.

The inner wrapper 39 further has a separating line 46 shown by a dashed line, the separating line 46 being formed of a line of perforations, too. Concretely, the separating line 46 includes a U-shaped portion $\mathbf{46}_U$ located in an upper portion of a front face of the inner pack IP, a portion $\mathbf{46}_S$ that, as viewed in FIG. 2, expands from the right edge of the U-shaped portion $\mathbf{46}_U$ through the folding side 42 of the inner pack IP via a lateral face of the inner pack 36, and a portion (not shown) that, as viewed in FIG. 2, intersects the other lateral face of the inner pack IP from the left edge of the U-shaped portion $\mathbf{46}_U$ up to one end edge of the inner wrapper 39. The above-described separating line 46 defines a cut-off section 48 in a part of the inner wrapper 39. The cut-off section 48 includes the upper closing flap 44 of the closing face 40.

Figure 3:
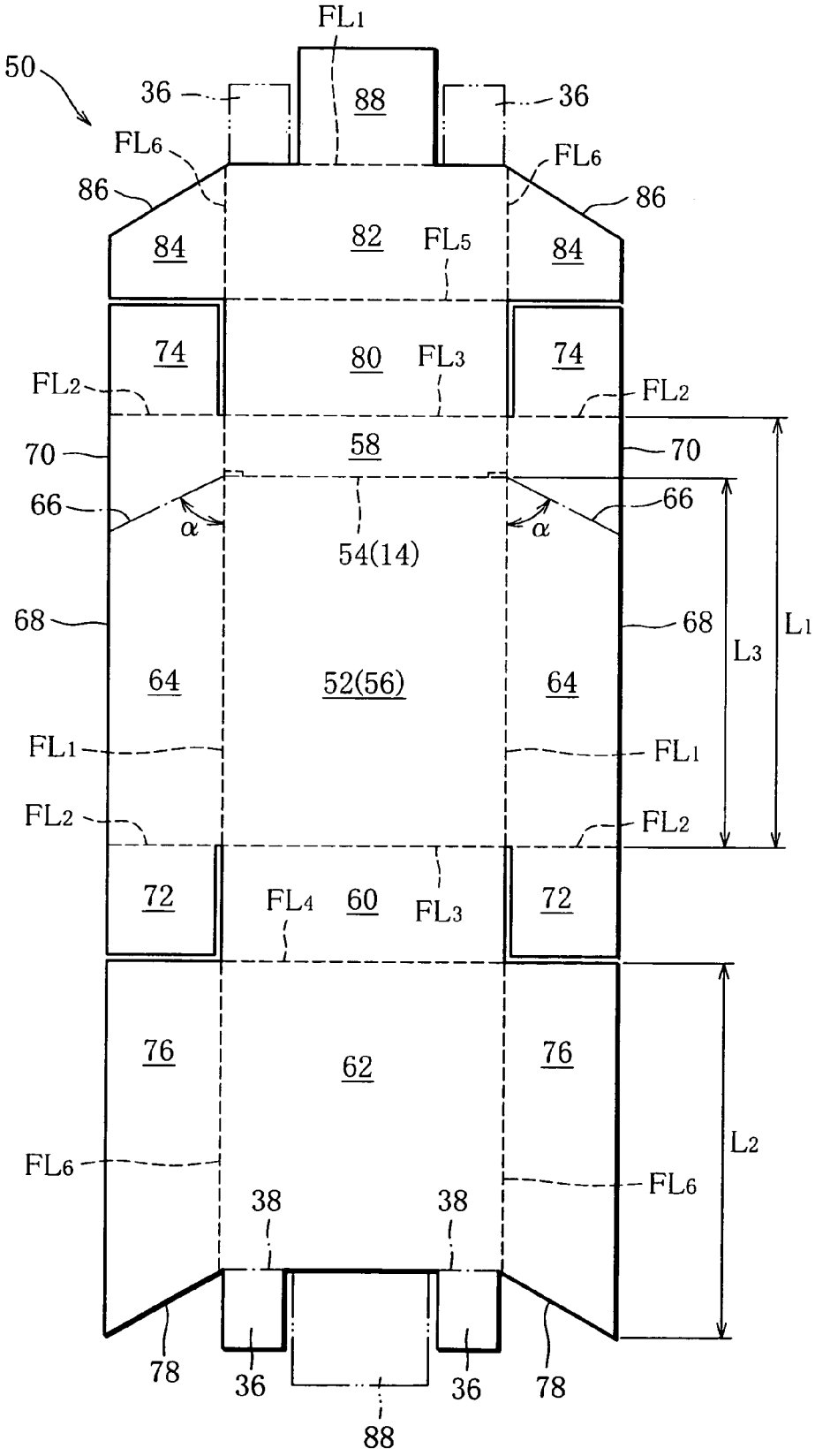
FIG. 3 shows a blank for forming the package of FIG. 1.

FIG. 3 shows a reverse face of a blank 50 for forming the outer body 10 and the lid 12.

The blank 50 is formed as a rectangle and includes a rear panel 52 at the center thereof. The rear panel 52 has length L equal to the height of the package and is provided with a folding line 54. In FIG. 3, the folding line 54 is located in an upper portion of the rear panel 52 and extends across the rear panel 52. The folding line 54 partitions the rear panel 52 into rear panel sections 56, 58 in this order from the lower end side of the rear panel 52. The folding line 54 corresponds to the self-hinge 16 for the lid 12, and the rear panel sections 56, 58 correspond to rear walls 18, 16 for the outer body 10 and the lid 12, respectively. The folding line 54 is provided with slits in both end portions. The slits improve flexibility of the folding line 54, that is, of the self-hinge 14.

Connected to a lower end of the rear panel section 56 through a folding line $FL_3$ is a bottom panel 60, and connected to a lower end of the bottom panel 60 through a folding line $FL_4$ is a body front panel 62. The body front panel 62 corresponds to the front wall 20 of the outer body 10. Accordingly in FIG. 3, a lower end edge of the body front panel 62 is the front edge of the opening end 26 and has a pair of connector tabs 36. The connector tabs 36 are connected to the body panel 62 through the braking lines 38. The connector tabs 36 are located near respective side edges of the body front panel 62 and protrude from the lower end of the body front panel 62 in parallel with each other. There is secured a space corresponding to thickness of the blank 50 in between each of the connector tabs 36 and the corresponding side edge of the body front panel 62.

Inner side flaps 64 are connected to respective side edges of the rear panel 52 through folding lines $FL_1$, and the inner side flaps 64 each have length equal to the entire length L of the rear panel 52. Each of the inner side flaps 64 has a separating line 66. The separating line 66 is formed of a line of perforations and extends from the corresponding end portion of the folding line 54 up to an outer side edge of the inner side flap 64 at a downward slant. An oblique angle of the separating line 66 with respect to the folding line $FL_1$ is shown by $\alpha$ in FIG. 3.

The separating line 66 partitions the inner side flap 64 into flap sections 68, 70 in this order from a lower end thereof. The flap sections 68, 70 become a part of the side walls 22, 30 of the outer body 10 and the lid 12.

Inner bottom flaps 72 and top inner flaps 74 are connected to respective lower and upper ends of the inner side flaps 64 through folding lines $FL_2$. The inner bottom flaps 72 are located on respective sides of the bottom panel 60.

Outer side flaps 76 are connected to respective side edges of the front panel 62 through folding lines $FL_6$. The outer side flaps 76 extend along the front panel 62 and have respective inclined ends 78 parallel with the corresponding separating lines 66 at lower ends thereof. The inclined ends correspond to the inclined side edges of the opening end 26. In addition, the outer side flap 76 has length $L_2$ equal to length $L_3$ of the panel section 56 of the rear panel 52.

A top panel 80 is connected to an upper end of the rear panel 52 through the folding line $FL_3$. The top panel 80 is located in between the inner top flaps 74.

A lid front panel 82 is connected to an upper end of the top panel 80 through a folding line $FL_5$. Outer side flaps 84 are connected to respective side edges of the lid front panel 82 through the folding lines $FL_6$, and the outer side flaps 84 are located above the respective inner top flaps 74.

Each of the outer side flaps 84 has an inclined end 86 parallel with the corresponding inclined end 78 at an upper end thereof. The inclined ends 86 correspond to respective inclined side edges of the opening end 34. An upper end of the lid front panel 82 corresponds to the front edge of the opening end 34. Connected to the upper end of the lid front panel 82 through a folding line $FL_1$ is an inner front flap 88. The inner front flap 88 is located at the center of the upper end of the lid front panel 82 so as to be positioned in between the connector tabs 36 on a width direction of the blank 50, as is apparent from FIG. 3.

A forming process of the package, namely the folding procedure of the blank 50, will be described with reference to FIGS. 4 through 10.

The flaps and panels of the blank 50 are folded along the folding lines $FL_1$ through $FL_6$. The folding procedure corresponds with the numbers attached to the folding lines FL. On the reverse face of the blank 50, an adhesive agent (not shown) is applied to prescribed places of the panels and flaps in advance. The places to which the adhesive agent is applied will become apparent from explanations provided below.

Figure 4:
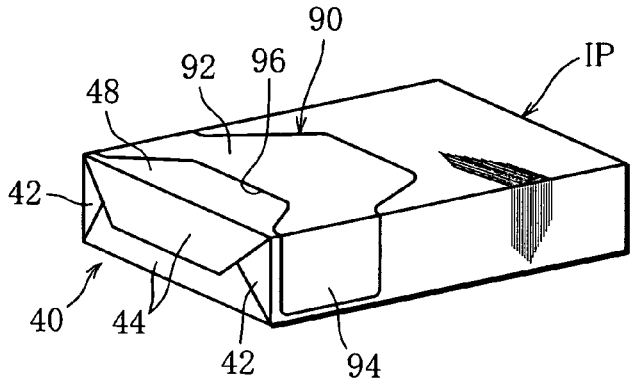
FIG. 4 is a perspective view showing an inner pack with an inner frame.

In the process of supplying the inner pack IP toward the blank 50, an inner frame 90 is attached to the inner pack IP as illustrated in FIG. 4. More specifically, the inner frame 90 is formed of another sub-blank differing from the blank 50. The inner frame 90 has a front portion 92 laid on a front face of the inner pack IP, and side portions 94 connected to respective sides of the front portion 92 through folding lines and superimposed on corresponding lateral faces of the inner pack IP. The inner frame 90 is located near an upper end of the inner pack IP, or the closing end 40, and there is formed a U-shaped opening 96 at an end of the closing end 40 side. The U-shaped opening 96 is congruous wit the U-shaped portion $\mathbf{46}_U$ of the separating line 46 (see FIG. 2).

Figure 5:
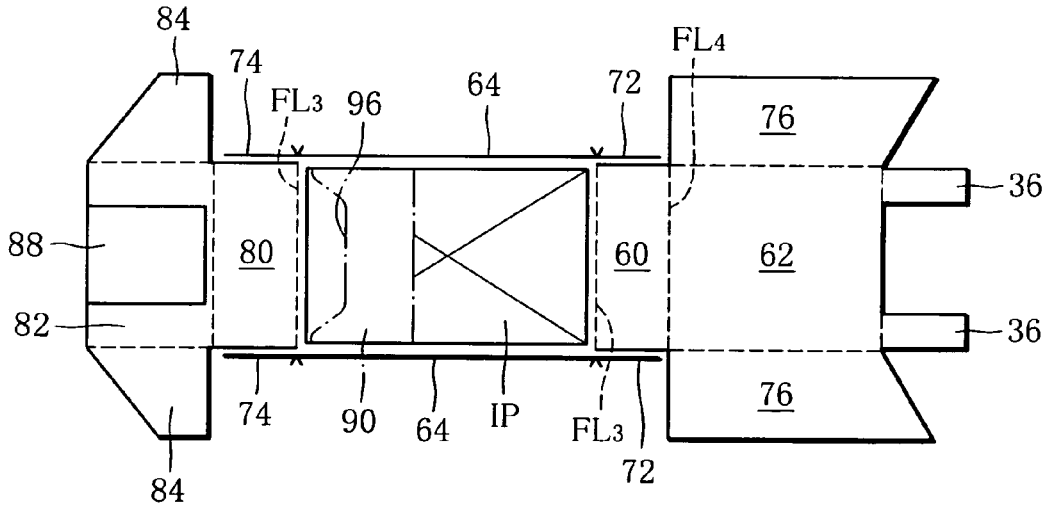
FIG. 5 is a view showing a first folding process of the blank of FIG. 3.

When the inner pack IP having the inner frame 90 is supplied onto the reverse face of the blank 50 as illustrated in FIG. 5, the inner pack IP is laid on the rear panel 52 in a state where the closing face 40 (see FIG. 4) is met with the folding line $FL_3$ of the top panel 80 and bonded to the panel section 56 of the rear panel 52 with the adhesive agent. At this time, the U-shaped opening 96 of the inner frame 90 faces upward as is apparent from FIG. 5.

Thereafter, both the inner side flaps 64 are folded along the folding lines $FL_1$ toward the inner pack IP to be superimposed on the respective lateral faces of the inner pack IP. At this time, the flap sections 68 of the inner side flaps 64 are adhered to the lateral faces of the inner pack IP with the adhesive agent. The above-described folding of the inner side flaps 64 makes upright the inner bottom flaps 72 and the top inner flaps 74, so that the flaps 72, 74 are placed on virtual extended planes of the lateral faces of the inner pack IP.

Simultaneously with the folding of the inner side flaps 64, the inner front flap 88 is also folded along the folding line $FL_1$. As is evident from FIG. 5, the inner front flap 88 is superimposed on the lid front panel 82 and glued to the lid front panel 82 with the adhesive agent. The lid front panel 82 and the inner front flap 88 form the front wall 28 of the lid 12.

Figure 6:
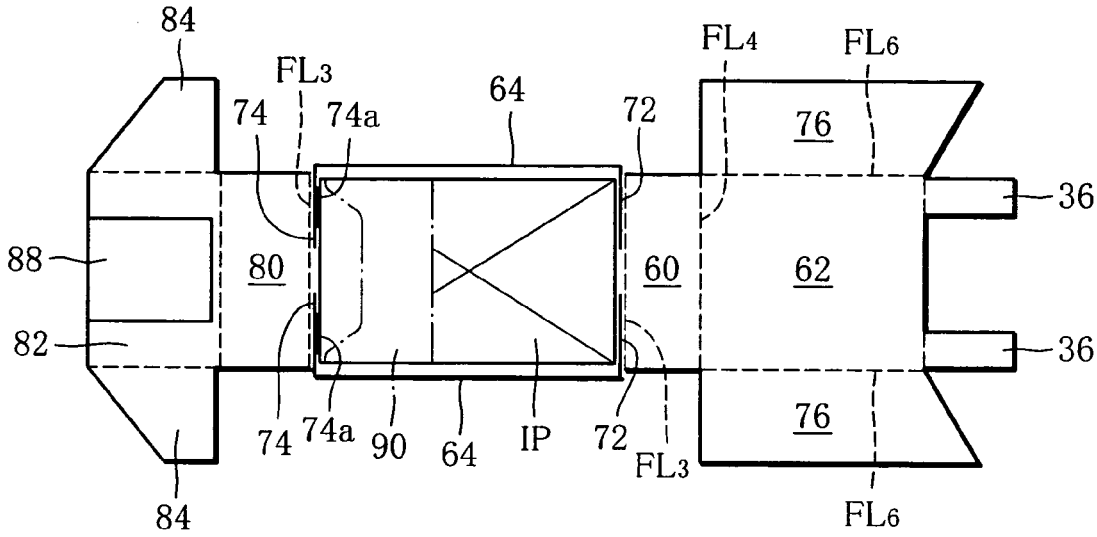
FIG. 6 is a view showing a subsequent folding process of the blank, which continues from the folded state illustrated in FIG. 5.

Subsequently both the inner bottom flaps 72 are folded along the folding lines $FL_2$ and superimposed on a bottom face of the inner pack IP as illustrated in FIG. 6. In parallel with the folding of the inner bottom flaps 72, both the inner top flaps 74 are folded along the folding lines $FL_2$ and superimposed on an upper face of the inner pack IP, or the closing face 40. In this step, each of the inner top flaps 74 is bonded to a part of the closing face 40, that is, the upper closing flap 44 (see FIG. 2) of the cut-off section 48, with the adhesive agent $\mathbf{74}_A$.

Figure 7:
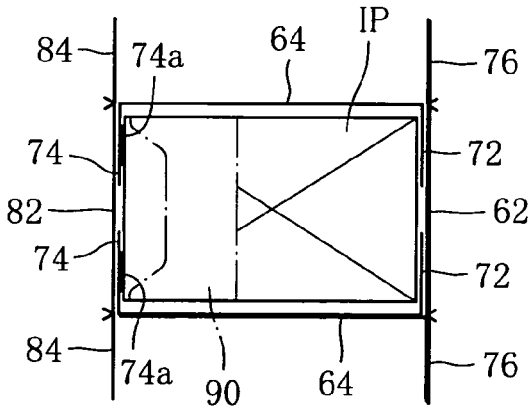
FIG. 7 is a view showing a subsequent folding process of the blank, which continues from the folded state illustrated in FIG. 6.

Thereafter, the bottom panel 60 is folded along the folding line $FL_3$ toward the bottom face of the inner pack IP. As illustrated in FIG. 7, when the bottom panel 60 is superimposed on the inner bottom flaps 72, the bottom panel 60 and the inner bottom flaps 72 form the bottom wall 24 of the outer body 10. The above-described folding of the bottom panel 60 makes upright the body front panel 62 together with the outer side flaps 76 located on respective sides thereof.

Simultaneously with the folding of the bottom panel 60, the top panel 80 is also folded along the folding line $FL_3$toward the upper face (closing face 40) of the inner pack IP. When the top panel 80 is superimposed on the inner top flaps 74, the top panel 80 and the inner top flaps 74 form the top wall 32 of the lid 12.

The folding of the top panel 80 makes upright the lid front panel 82 together with the outer side flaps 84.

Figure 8:
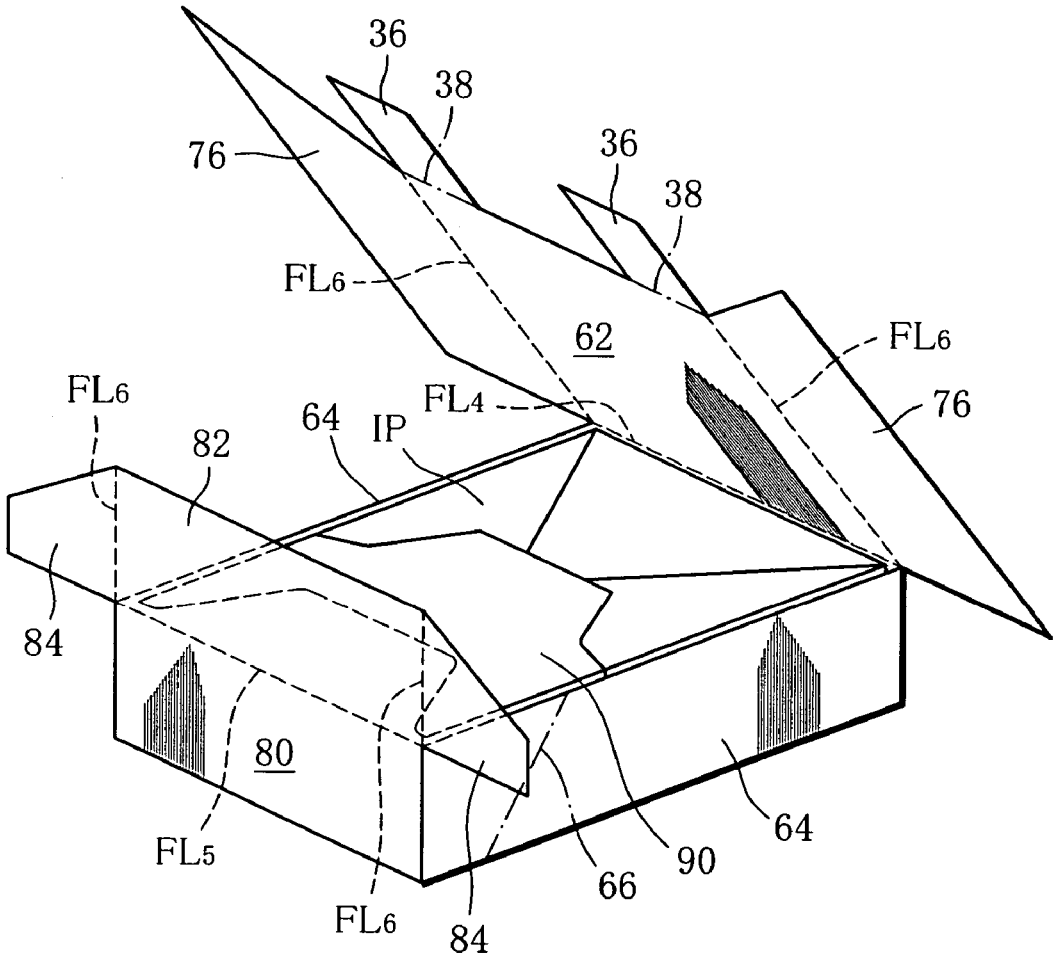
FIG. 8 is a view showing a subsequent folding process of the blank, which continues from the folded state illustrated in FIG. 7.
Figure 9:
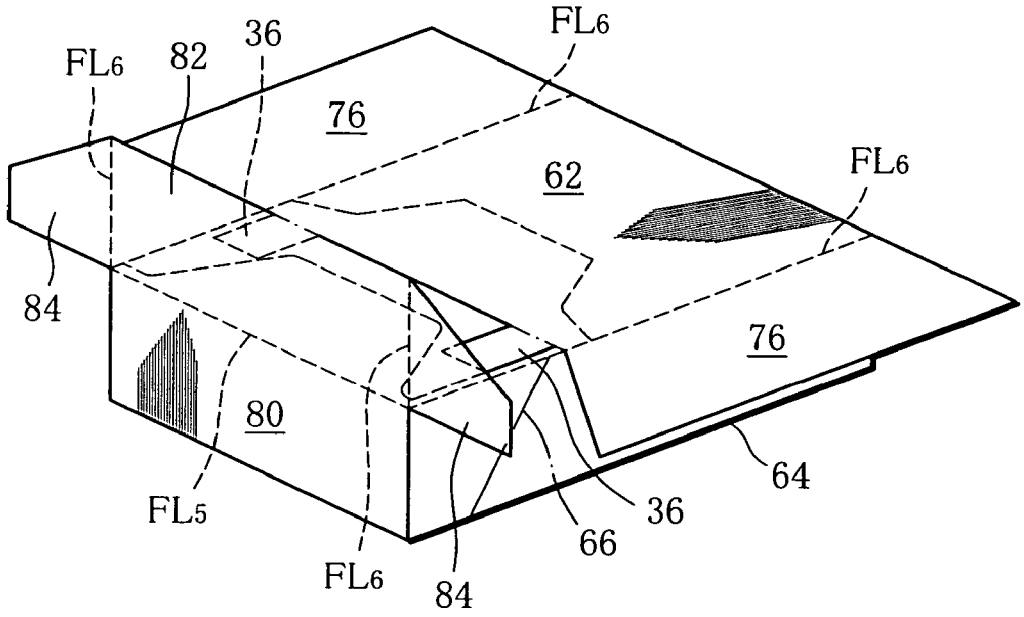
FIG. 9 is a view showing a state in which the folding process illustrated in FIG. 8 is completed.

In the next step, as illustrated in FIG. 8, the body front panel 62 is folded along the folding line $FL_4$ and laid on the inner frame 90 and the inner pack IP to be adhered to the front face of the inner pack IP. At this time, the connector tabs 36 are superimposed on respective side portions of the inner frame 90 as illustrated in FIG. 9. The connector tabs 36 and the inner frame 90 are in a non-adhered state with respect to each other, and the outer side flaps 76 protrude from the inner side flaps 64 to the side thereof.

Figure 10:
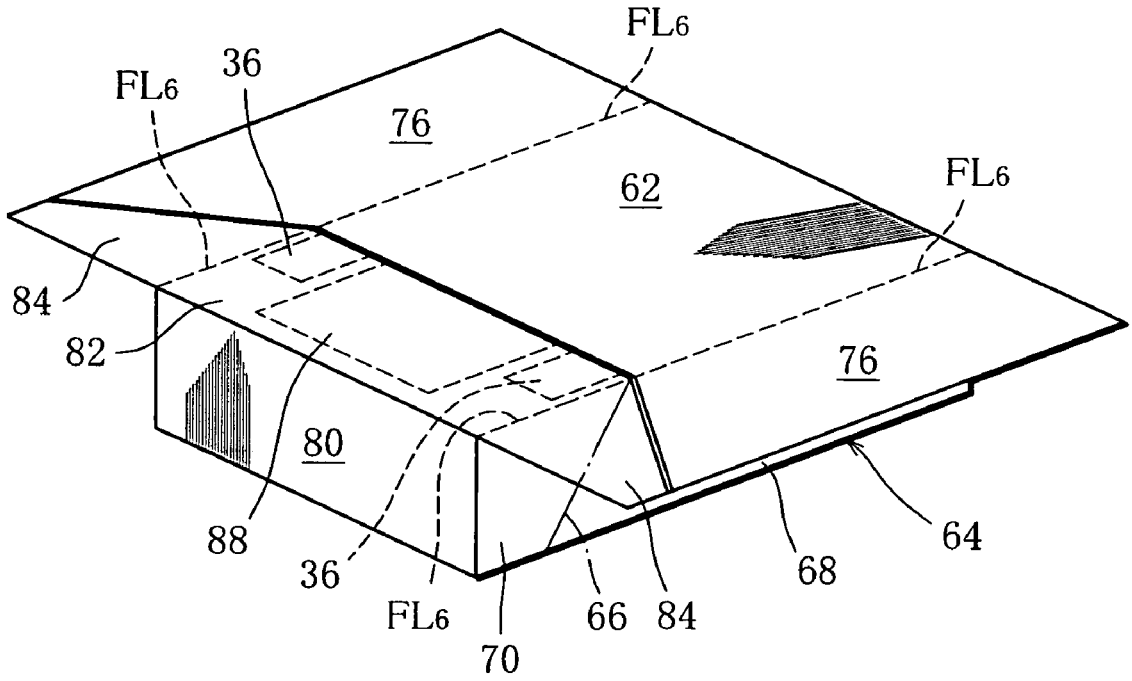
FIG. 10 is a view showing a subsequent folding process of the blank, which continues from the folded state illustrated in FIG. 9.

After the folding of the body front panel 62 is completed, the lid front panel 82 is folded along the folding line $FL_5$ and laid on the inner frame panel 90 with the inner front flap 88 sandwiched therebetween as illustrated in FIG. 10. The inner front panel 88 is located in between the connector tabs 36 and glued to the cut-off section 48 (see FIG. 2) of the inner pack IP through the U-shaped opening 96 of the inner frame 90. At the same time with the adhesion of the inner front flap 88 and the cut-off section 48, the inner front panel 88 is bonded to the connector tabs 36.

When folded, the lid front panel 82 is adjacent to the body front panel 62 with a gap therebetween. The outer side flaps 84 of the lid front panel 82 also protrude from the inner side flaps 64 to the side thereof and are located adjacent to the outer side flaps 76 of the body front panel 62 with a gap therebetween.

Thereafter, the outer side flaps 76, 84 are folded along the folding lines $FL_6$ toward the corresponding inner side flaps 64. Once the outer side flaps 76, 84 are superimposed on and adhered to the inner side flaps 64, the forming of the package shown in FIG. 1 is completed.

More exactly, the outer side flaps 76 are superimposed on and glued to the flap sections 68 of the inner side flaps 64, to thereby form the side walls 22 of the outer body 10. On the other hand, the outer side flaps 84 are superimposed on and adhered to the flap sections 70 of the inner side flaps 64, to thereby form the side walls 30 of the lid 12. When the outer side flaps 76, 84 are bonded to the inner side flaps 64 in this manner, the gaps between the outer side flaps 76, 84 coincide with the separating lines 66 of the inner side flaps 64.

Referring to the package shown in FIG. 1, the lid 12 is in the closed position, and the outer body 10 and the lid 12 are in a connected state with respect to each other through the connector tabs 36 and the separating lines 66.

When the lid 12 is applied with the opening force for the first time in the above state, that is to say, when the lid 12 is pulled in a direction of moving away from the opening end 26 of the outer body 10 or when the lid 12 is applied with a rotating force around the self-hinge 14 in the opening direction, the connector tabs 36 are broken along the breaking lines 38. Simultaneously with the breaking, the inner side flaps 64 are also separated along the separating lines 66.

When the connector tabs 36 and the inner side flaps 66 are broken and separated in the above manner, the lid 12 is allowed to rotate around the self-hinge 14, which makes the lid 12 openable and closable.

As mentioned above, each of the inner side flaps 64 is not preliminarily divided into the flap sections 68, 70, but the flap sections 68, 70 are zoned with the separating line 66 therebetween. Therefore even if the lid 12 is applied with an external force other than the opening force, the connector tabs 36 are not broken by accident.

Figure 11:
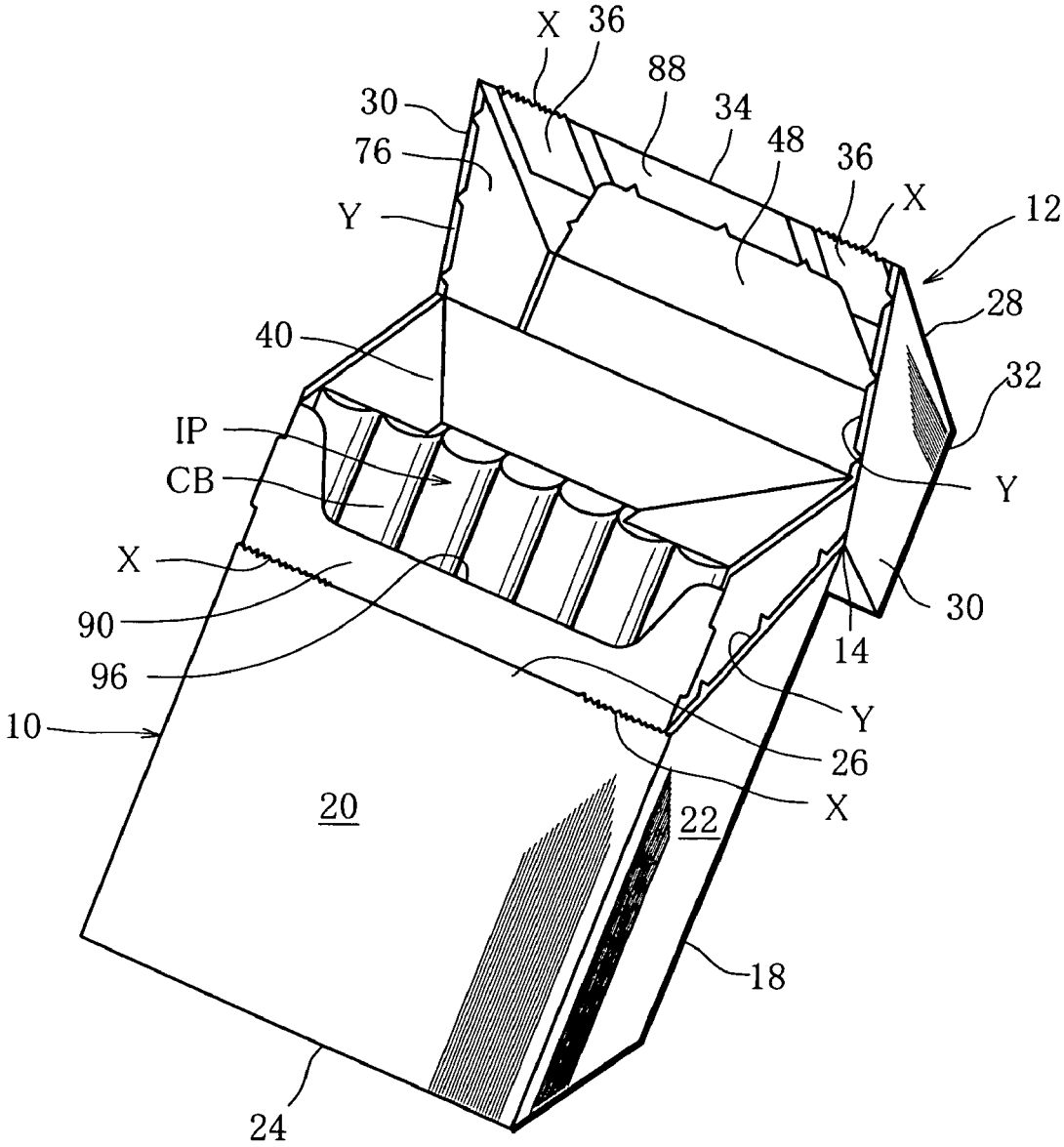
FIG. 11 is a perspective view showing a state in which the package of FIG. 1 is opened.

Since the cut-off section 48 of the inner pack IP is adhered to the inner face of the lid 12, or the inner top flap 74 and the inner front flap 88 as described above, when the lid 12 is opened, the cut-off section 48 is detached along the separating line 46 and removed from the inner pack IP. The cut-off section 48 removed in this manner is kept attached onto the inner surface of the lid 12 as illustrated in FIG. 11. This exposes a part of the cigarette bundle CB contained in the inner pack IP through the U-shaped opening 96 of the inner frame 90.

As is clear from FIG. 11, the breaking of the connector tabs 36 leaves breaking traces X in the opening ends 26, 34 of the outer body 10 and the lid 12. Likewise, the detachment of the inner side flaps 64 leaves breaking traces Y in the opening ends 26, 34 of the outer body 10 and the lid 12.

Even if the lid 12 is closed again, the breaking traces X are clearly visible from the outside of the package and therefore effectively serve as a countermeasure against tampering on the cigarette bundle CB.

Consequently, the package of the present invention does not require the film wrapping, which prevents the over wrapping of cigarette bundles CB. Moreover, there is no need for equipment for the film wrapping at the time of manufacturing the packages of the invention, so that the packages can be produced at low cost. Since the film wrapping with a tear tape is not necessary, the package of this invention never incurs the above-mentioned trouble attributable to the pull end of the tear tape at the time of dispensing the package from a vending machine.

When the lid 12 is opened for the first time, the cut-off section 48 of the inner pack IP is automatically removed, so that the user does not have to get rid of the cut-off section 48. Moreover, since the cut-off section 48 is adhered to the inner surface of the lid 12, the user need not discard the cut-off section 48 separately from the package.

The present invention is not limited to the package of the first embodiment, but may be modified in various ways.

Figure 12:
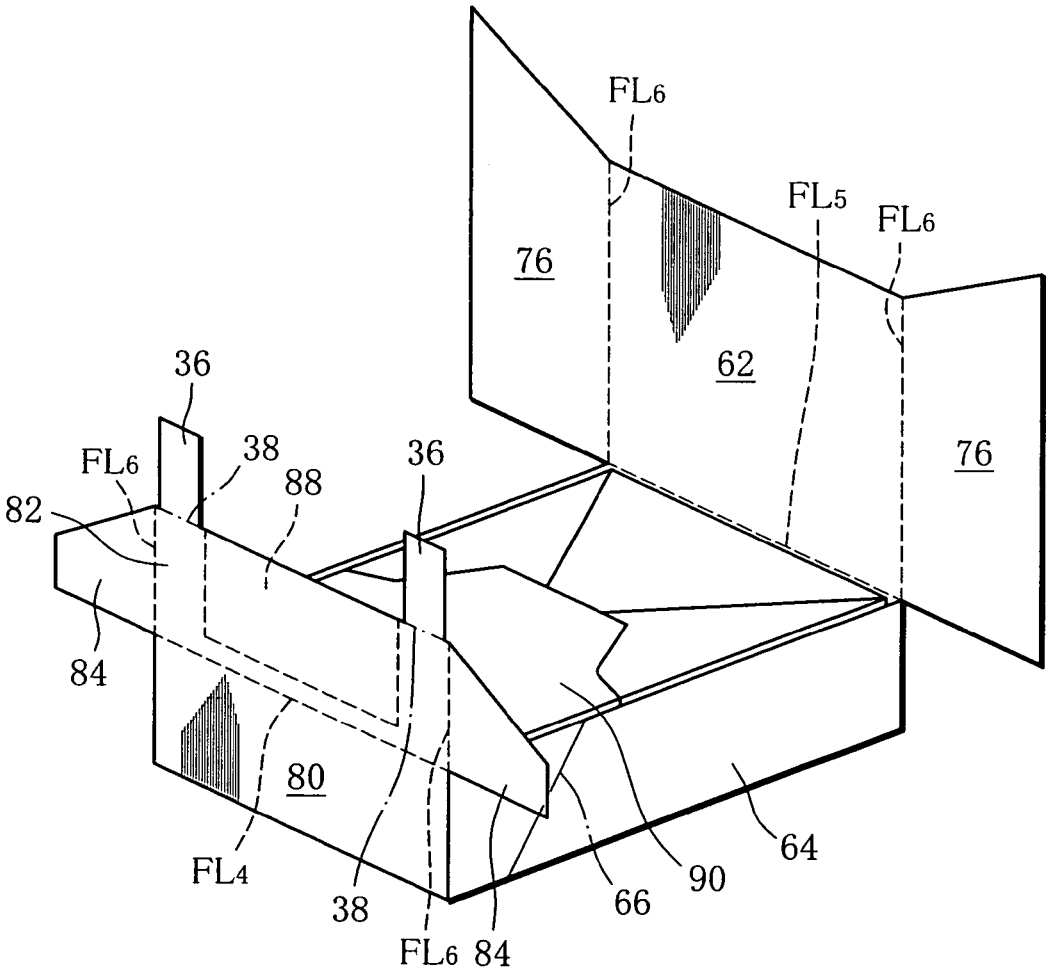
FIG. 12 is a view showing one folding process of a blank of a second embodiment.

As shown by chain double-dashed lines in FIG. 3, the connector tabs 36 may be connected to the upper end of the lid front panel 82 through the breaking lines 38 (see FIG. 12). In this case, the connector tabs 36 are positioned on respective sides of the inner front flap 88.

The connector tabs 36 are not necessarily required. In the absence of the connector tabs 36, the inner front flap 88 may be connected to the lower end of the body front flap 62 through a breaking line 98 (see FIG. 13).

In the former case, from the folded state of the blank 50 shown in FIG. 12, the lid front panel 82 is further folded along the folding line $FL_4$. The lid front panel 82 is first superimposed on the inner frame 90 along with the connector tabs 36. In this step, the inner front flap 88 is adhered to the cut-off section 48 of the inner pack IP, and the connector tabs 36 is adhered to the inner frame 90. The body front panel 62 is then folded along the folding line $FL_5$ and glued to the front face of the inner pack IP and the connector tabs 36. As a result, the connector tabs 36 are sandwiched between the body front panel 62 and the inner frame 90.

Also in the case of the package produced from the blank 50 of FIG. 12, when the connector tabs 36 are separated along the breaking lines 38, the connector tabs 36 leave the breaking traces X in both the opening ends 26, 34 of the outer body 10 and the lid 12.

Figure 13:
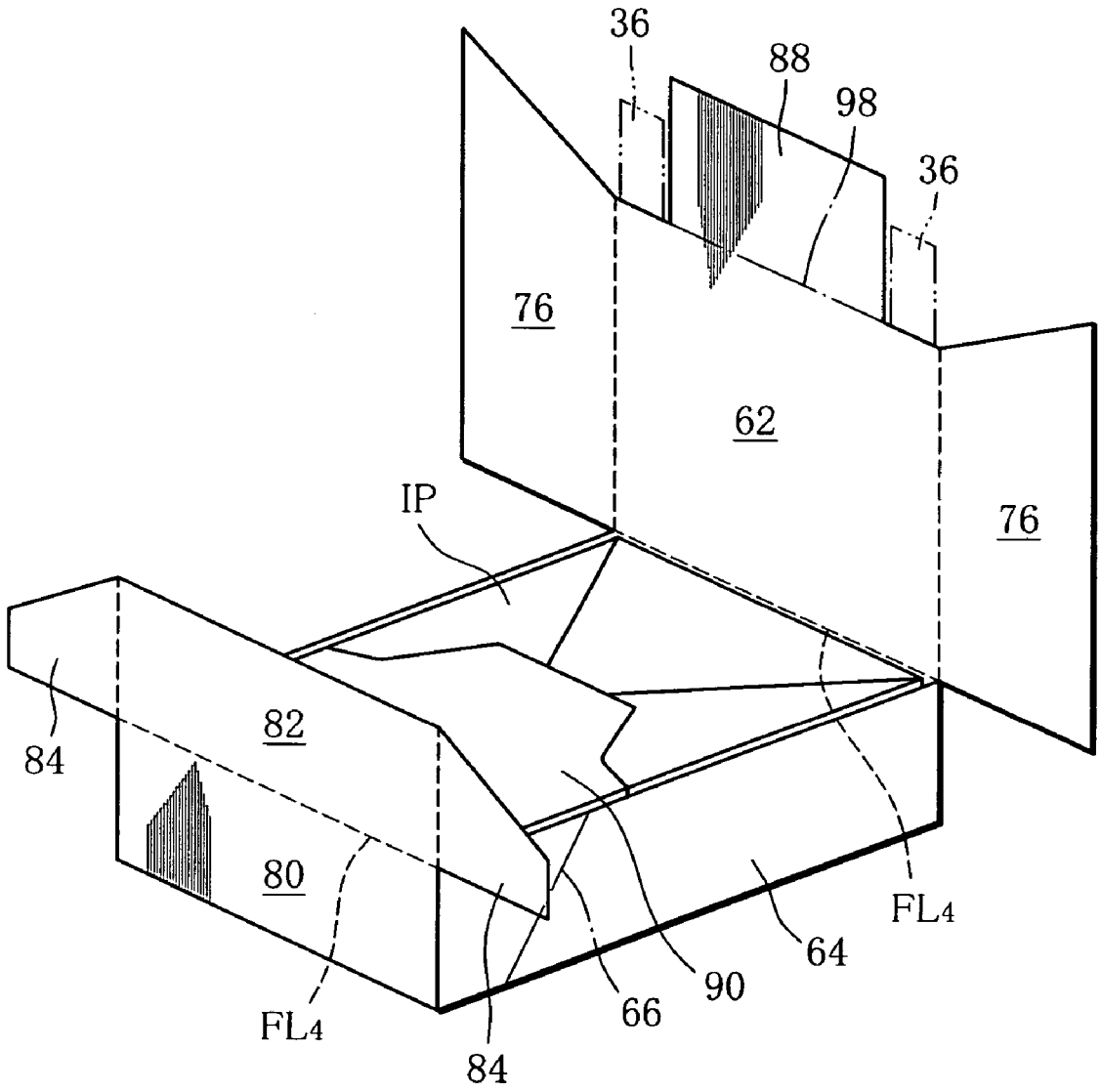
FIG. 13 is a view showing one folding process of a blank of a third embodiment.

In the latter case, from the folded state of the blank 50 shown in FIG. 13, the body front panel 62 is further folded along the folding line $FL_4$, and the inner front flap 88 is laid on the inner frame 90 along with the body front panel 62. At this time, the inner front flap 88 and the inner frame 90 are in a non-adhered state with respect to each other, but the inner front flap 88 is bonded to the cut-off section 48 of the inner pack IP.

Subsequently the lid front panel 82 is folded along the folding line $FL_5$ and laid on the inner front flap 88 and the inner frame 90. In this step, the lid front panel 82 is adhered only to the inner front flap 88, to thereby form the front wall 28 of the lid 12 with the inner front flap 88.

In the case of the package produced from the blank of FIG. 13, when the inner front flap 88 is detached along the breaking line 98, the inner front flap 88 leaves breaking traces (not shown) in both the opening ends 26, 34 of the outer body 10 and the lid 12.

In the case of the blank 50 shown in FIG. 13, as shown by a chain double-dashed line, the body front panel 62 may have the connector tabs 36 on respective sides of the inner front flap 88.

The package described above is provided with four sharp side corners that extend between the bottom wall 24 of the outer body 10 and the top wall 32 of the lid 12. The package of the invention, however, may have round side corners in stead of having the sharp side corners.

The invention claimed is:

1. A hinge-lid type package for rod-like smoking articles, comprising:

an inner pack having an inner wrapper in which a bundle of rod-like smoking articles is wrapped; and a rectangular parallelepiped casing for accommodating said inner pack, wherein:

said casing includes:

an outer body with an opening end;

an inner frame partially projecting from the opening end of the outer body with a projecting end of the inner frame forming a top opening of the casing;

a lid connected to the opening end of said outer body with a rear edge of the opening end used as a hinge, for opening and closing the opening end of said outer body, said lid having an opening end for meeting the opening end of said outer body so that the opening ends are confronted with each other when in a closed position, said lid being adapted to open and close the top opening of the casing wherein when said lid is in a closed position the lid covers the projecting end of the inner frame; and a breakable connecting element for connecting the opening end of said outer body and the opening end of said lid when said casing is formed, said breakable connecting element being positioned inside said casing, wherein said connecting element includes a connector tab connected to a front edge of either one of the opening end of said outer body and that of said lid through a breaking line, and the connector tab extends over the front edge of the other opening end and is adhered to an inner surface of said outer body or said lid that has the other opening end.

2. The package according to claim 1, wherein:

said package further includes a separating line that detachably connects side edges of the opening end of said outer body and side edges of the opening end of said lid.

3. The package according to claim 2, wherein:

side walls of said outer body and side walls of said lid each have an inner wall layer and an outer wall layer, and said separating line detachably connects the inner wall layer of said outer body and the inner wall layer of said lid.

4. The package according to claim 3, wherein:

said connecting element has a connecting flap connected to the front edge of the opening end of said outer body through a breaking line, and said connecting flap extends over the front edge of the opening end of said lid into said lid, to thereby form an inner wall layer of a front wall of said lid.

5. The package according to claim 1, wherein:

said connecting element includes a pair of said connector tabs located in respective end portions of the front edge of the opening end.

6. A hinge-lid type package comprising an inner pack having an inner wrapper in which a bundle of rod-like smoking articles is wrapped, and a casing for accommodating the inner pack, wherein said casing includes an outer body with an opening end and a lid connected to the opening end of the outer body with a rear edge of the opening end used as a hinge, for opening and closing the opening end of said outer body, said lid having an opening end for meeting the opening end of said outer body so that the opening ends are confronted with each other when in a closed position, wherein:

a blank for forming said casing includes:

a body front panel having a first outer edge portion for forming the opening end of said outer body;

a lid front panel having a second outer edge portion for forming the opening end of said lid;

a connecting element connected to either one of said first and second outer edge portions through a breaking line, and when said casing is formed from said blank, said connecting element outwardly protrudes from said one of the outer edge portions so as to be superimposed on the front panel having the other of said first and second outer edge portions; and an inner frame partially projecting from the opening end of the outer body with a projecting end of the inner frame forming a top opening of the casing, said lid being adapted to open and close the top opening of the casing wherein when said lid is in a closed position the lid covers the projecting end of the inner frame and said connecting element being positioned inside said casing for connecting said lid with said casing, wherein said connecting element is a pair of connector tabs connected to the first outer edge portion of said body front panel through said breaking line, and the connector tabs are located at respective ends of the first outer edge portion.

7. The blank according to claim 6, wherein:

said blank includes inner side flaps forming inner wall layers of side walls for both said outer body and said lid, and the inner side flaps each have a separating line that separably partitions said inner wall layer into an outer body-side portion and a lid-side portion.

8. The blank according to claim 7, wherein:

said connecting element is a connecting flap connected to the first outer edge portion of said body front panel through said breaking line, and said connecting flap forms the inner wall layer of the front wall of said lid when said casing is formed from said blank.

* * * * *